US009638403B1

(12) United States Patent
Marshal

(10) Patent No.: US 9,638,403 B1
(45) Date of Patent: May 2, 2017

(54) LED STREET LIGHT CONFIGURED FOR TOOL-LESS INSTALLATION AND A METHOD OF INSTALLATION

(71) Applicant: AMLED TECHNOLOGIES, INC., Alsip, IL (US)

(72) Inventor: Madan Marshal, Alsip, IL (US)

(73) Assignee: AMLED Technologies, Inc., Itasca, IL (US)

( * ) Notice: Subject to any disclaimer, the term of this patent is extended or adjusted under 35 U.S.C. 154(b) by 0 days.

(21) Appl. No.: 14/997,708

(22) Filed: Jan. 18, 2016

(51) Int. Cl.

| | |
|---|---|
| ***F21V 21/116*** | (2006.01) |
| ***F21V 15/01*** | (2006.01) |
| ***F21V 21/108*** | (2006.01) |
| ***F21S 8/08*** | (2006.01) |
| ***F21V 19/00*** | (2006.01) |
| ***F21V 23/00*** | (2015.01) |
| *F21Y 101/02* | (2006.01) |

(52) U.S. Cl.
CPC ..... *F21V 21/116* (2013.01); *F21S 8/086* (2013.01); *F21V 15/01* (2013.01); *F21V 19/003* (2013.01); *F21V 21/108* (2013.01); *F21V 23/009* (2013.01); *F21Y 2101/02* (2013.01)

(58) Field of Classification Search
CPC ..... F21Y 2101/02; F21Y 2105/00; F21Y 2105/003; F21Y 2105/006; F21Y 2105/02; F21Y 2105/022; F21Y 2105/025; F21V 21/116; F21V 15/01; F21V 19/003; F21V 19/0035; F21V 23/026; F21V 19/004; F21S 8/086; F21W 2131/10; F21W 2131/101; F21W 2131/103; F21W 2131/105; F21W 2131/107; F21W 2131/109
See application file for complete search history.

(56) References Cited

U.S. PATENT DOCUMENTS

| | | | | |
|---|---|---|---|---|
| 3,888,446 | A * | 6/1975 | O'Brien | F16B 7/0486 248/230.1 |
| 8,585,258 | B2 * | 11/2013 | Ham | F21V 29/20 362/294 |
| 9,163,823 | B2 * | 10/2015 | Choksi | F21V 29/2206 |
| 2012/0280639 | A1 * | 11/2012 | Lin | F21S 8/06 315/312 |
| 2015/0070923 | A1 * | 3/2015 | Kadowaki | F21S 48/1104 362/517 |
| 2015/0260362 | A1 * | 9/2015 | Koga | F21V 19/045 362/362 |

FOREIGN PATENT DOCUMENTS

| | | | | |
|---|---|---|---|---|
| IT | WO 2015063807 | A1 * | 5/2015 | F21S 8/086 |
| TW | DE 102013100026 | A1 * | 7/2014 | F21V 25/02 |

* cited by examiner

*Primary Examiner* — Robert May
(74) *Attorney, Agent, or Firm* — Witters & Associates; Steve Witters

(57) ABSTRACT

An LED street light comprising a housing having a support arm extending from a light emitting portion is presently disclosed. The support arm is configured and disposed to tool-lessly fastened and unfastened to and from a street light post. An LED PCB having an array of LEDs is tool-lessly removably held in the light emitting portion of the LED street light. A tool-lessly removable driver is housed in the LED street light. A method of installing the street light of the present disclosure to a light post is also disclosed herein.

17 Claims, 14 Drawing Sheets

LED STREET LIGHT CONFIGURED FOR TOOL-LESS INSTALLATION AND A METHOD OF INSTALLATION

FIELD OF THE DISCLOSURE

The invention relates to a street light, and more particularly to an LED street light.

BACKGROUND

Because light-emitting diodes (LEDs) have many advantages over some other types of lighting, such as reduced power consumption, long service life, environmental conservation, etc., they are increasingly being applied to a variety of lighting fields. For example, the light-emitting diodes may be used in street lights. However, typical street lights may be difficult and time consuming to install and may require a variety of tools for installation.

What is needed is an LED street light that may improve upon one or more deficiencies of the prior art.

SUMMARY

In one aspect of the present disclosure, an LED street light comprising a housing having a support arm extending from a light emitting portion is provided. A lock may be in the support arm, the lock may be configured and disposed to tool-lessly fasten and unfasten the support arm to and from a street light post. An LED PCB having an array of LEDs may be tool-lessly removably held in the light emitting portion of the LED street light. A tool-lessly removable driver may be housed in the LED street light and may be configured and disposed to electrically connect to a power source and power the array of LEDs.

In another aspect of the present disclosure, a method for tool-lessly installing an LED street light is provided. The method may comprise the steps of: sliding a support arm onto a street light post; rotating a cam lock, by hand, and gripping and holding the support arm to the street light post; placing a driver on a driver holder; clipping portions of a driver holder together and holding the driver in the housing; placing an LED PCB in a light emitting portion of a housing; rotating at least two LED PCB holders and holding the LED PCB in the light emitting portion; rotating a lower lid assembly, about a hinge, to mate with an upper lid assembly; and locking the lower lid assembly to the upper lid assembly.

BRIEF DESCRIPTIONS OF THE DRAWINGS

The following Figures, which are idealized, are not to scale and are intended to be merely illustrative of aspects of the present disclosure and non-limiting. In the drawings, like elements are depicted by like reference numerals. The drawings are briefly described as follows.

DETAILED DESCRIPTION

Figure 1:
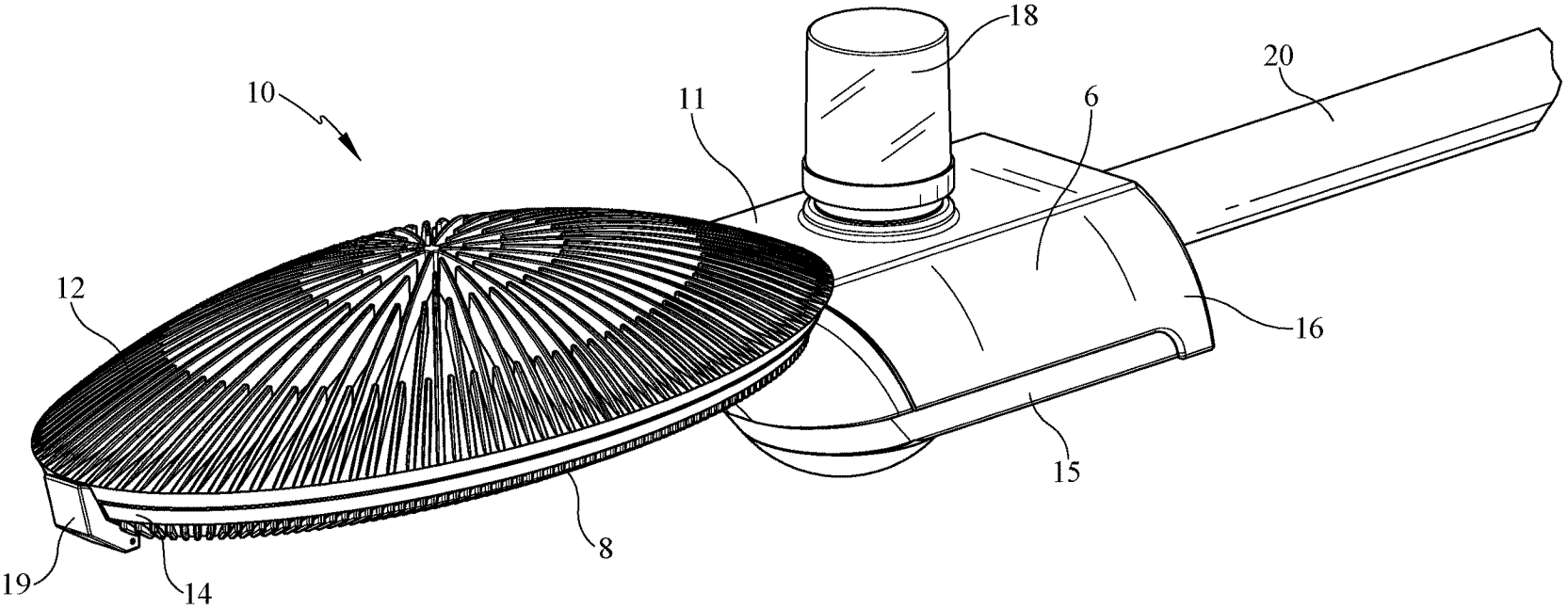
FIG. 1 is a perspective view of an LED street light of the present disclosure.
Figure 2A:
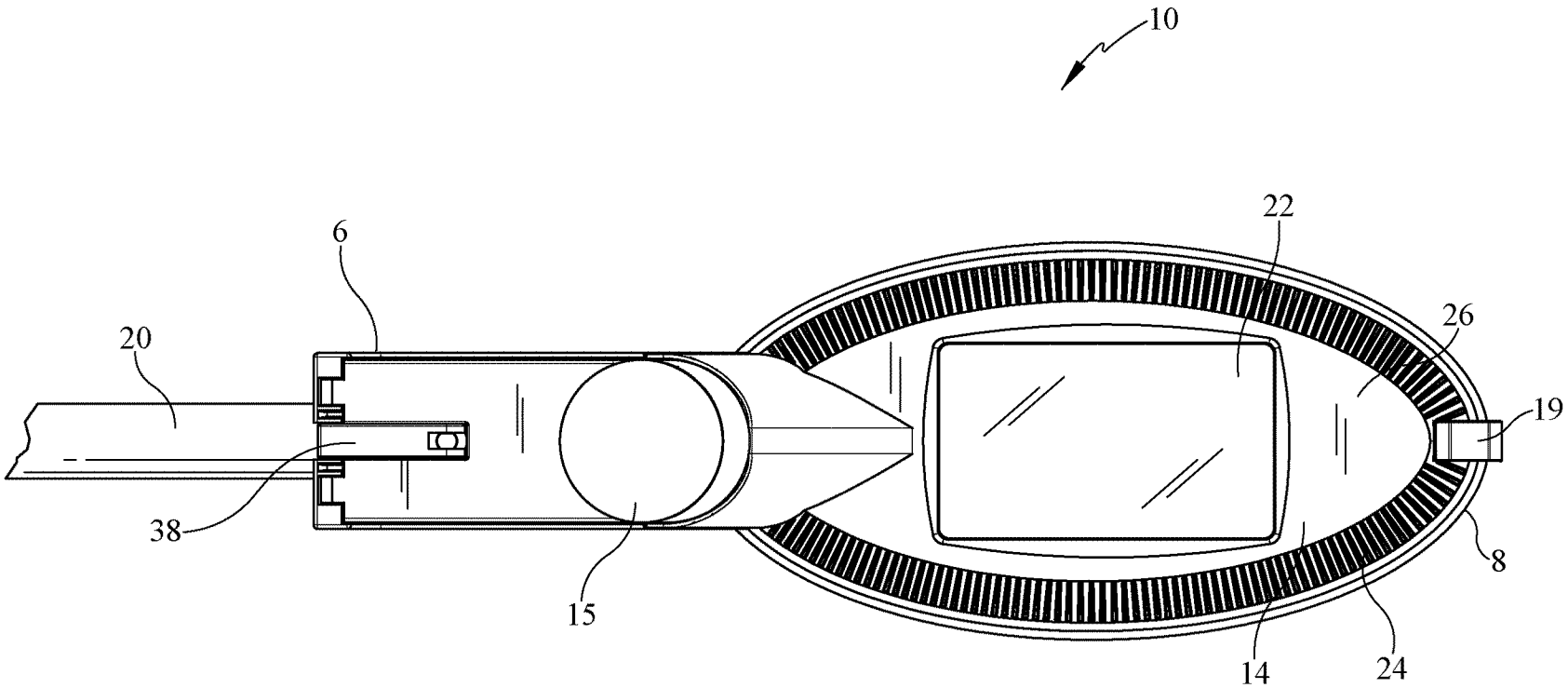
FIGS. 2A-2E are bottom, side, top, front, and rear views of the LED street light shown in FIG. 1.
Figure 2B:
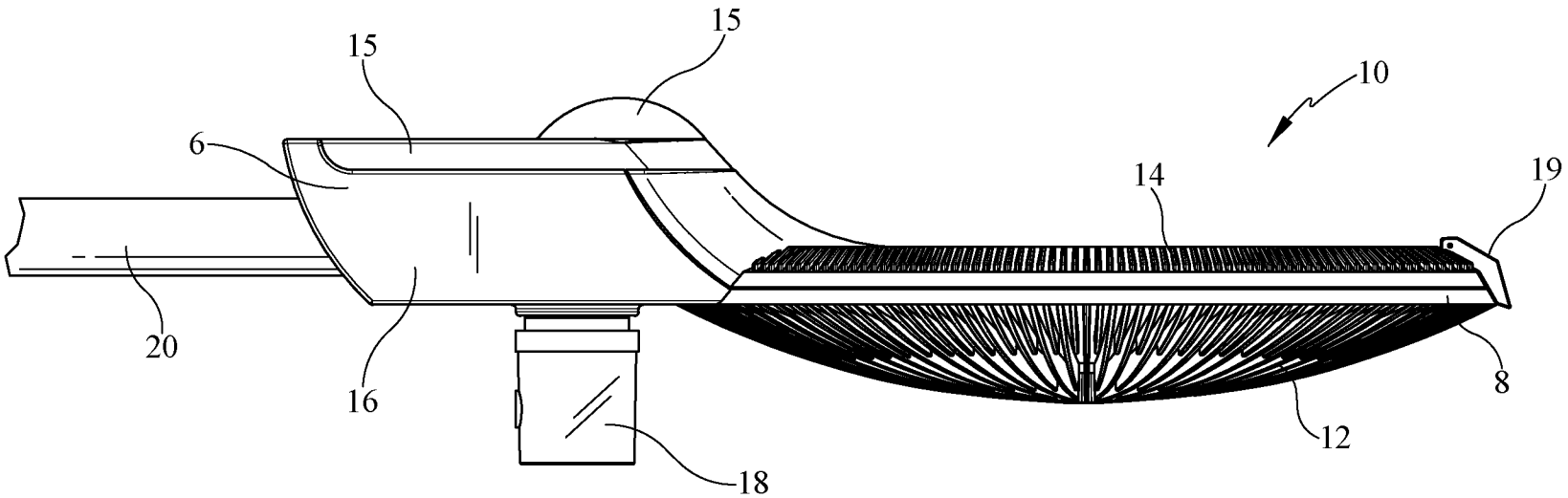
Figure 2C:
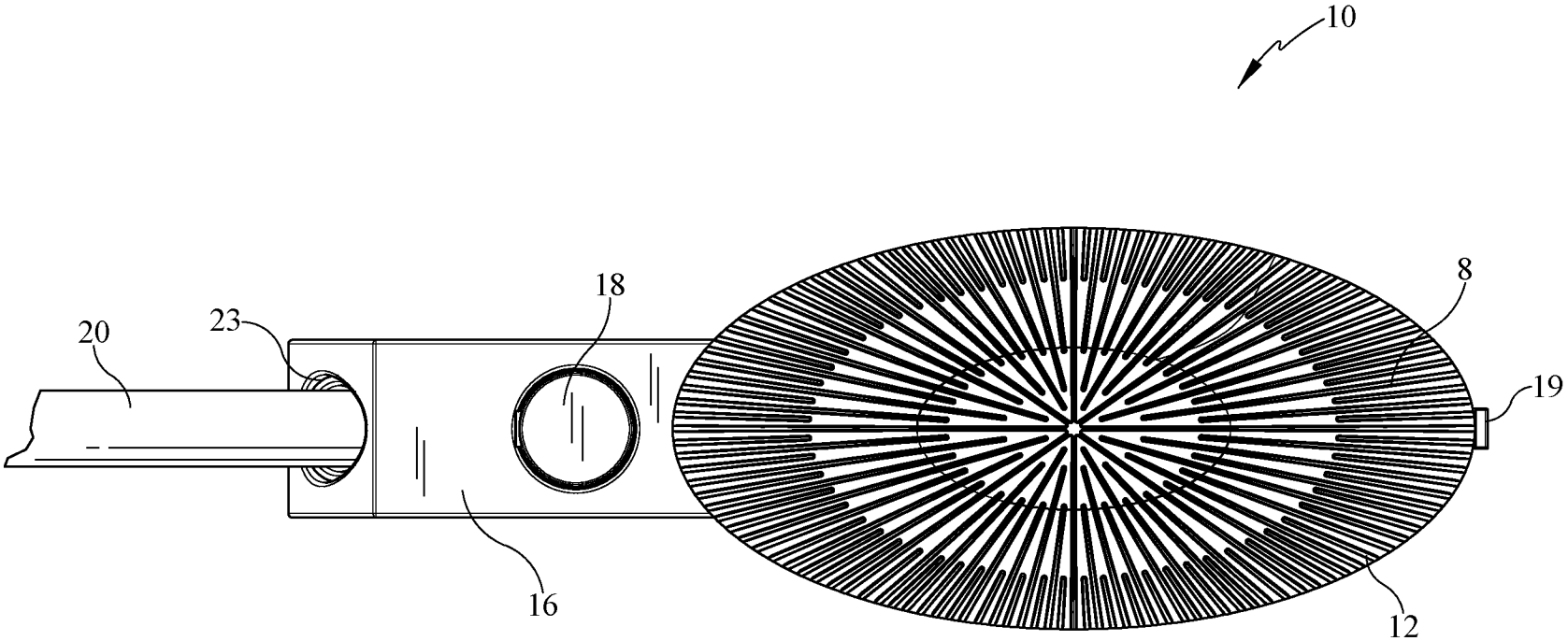
Figure 2E:
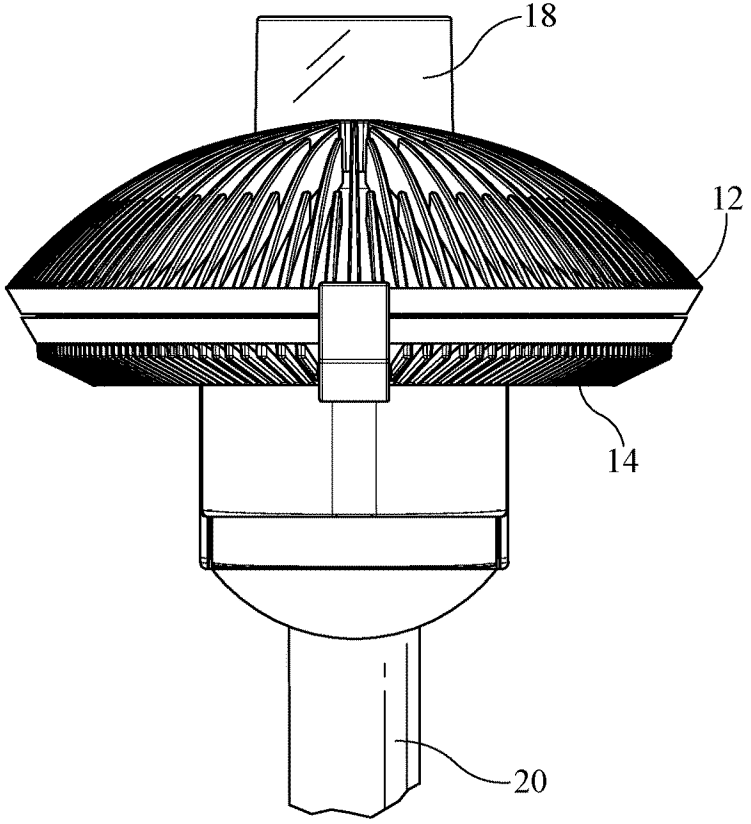
Figure 2D:
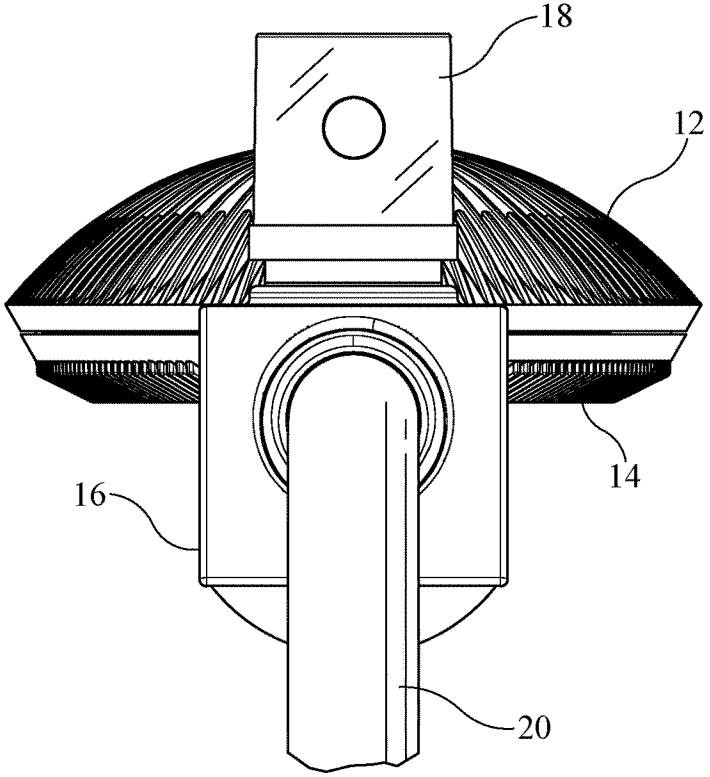

The present disclosure provides a street light that may be tool-lessly maintenance and installed on a light post. For example, a PCB may be removed by opening the street light and rotating clips holding the PCB and a driver may be removed by unclipping a driver holder. The street light may be installed on a post by rotating an arm lock.

Reference will now be made in detail to the present exemplary embodiments and aspects of the present invention, examples of which are illustrated in the accompanying figures. The same reference numbers may be used in the figures to refer to the same or like parts. The presently disclosed embodiments, aspects, and features of the present invention are not to limit the presently claimed invention as other and different embodiments, aspects, and features will become apparent to one skilled in the art upon reading the present disclosure.

FIGS. 1 and 2*a*-2*e* show a perspective, bottom, side, top, left side, and right side view of LED street light 10. LED street light 10 has a support arm 6 extending from a light emitting portion 8. Housing 11 has an upper lid assembly 12 and lower lid assembly 14 hingedly joined, proximate light post 20. A locking mechanism 19 may be configured and disposed to releasably hold upper lid assembly 12 with lower assembly 14.

Upper lid arm 16 may have an opening 23 configured and disposed to receive light post 20. Controller 18 may extend from upper lid arm 16. Upper lid assembly 12 may have an oval perimeter about its light emitting portion 8 and may have an upper surface that is rounded outwardly, having a volume therein. The upper surface of the light emitting portion 8 of upper lid assembly 12 may have a design thereon, such as radial fins directed toward its center.

Lower lid arm 15 may be hingedly joined with upper lid arm 16, proximate light post 20, and have edges configured and disposed to mate with edges of upper lid arm 16. Lower lid arm 15 and upper lid arm 16 may mate together and form support arm 6, supporting light emitting portion 8. Lower lid arm 15 may have a slot opening configured and disposed to provide access to cam arm 38.

The light emitting portion 8 of lower lid assembly 14 may have an oval perimeter configured to mate with, or become coincident with, the perimeter of light emitting portion 8 of upper lid assembly 12, when held together with upper lid assembly 12, with locking mechanism 19.

Lower lid assembly 14 may have a downward extending portion 24 proximate the perimeter of its light emitting portion 8. Downward extending portion 24 may have a design thereon. For example, downward extending portion 24 may have a similar fin design as light emitting portion 8 of upper lid assembly 12, as shown in FIGS. 1 and 2*a*-2*e*. Lower lid assembly 14 may have inward extending portion 26, extending inwardly from downward extending portion 24. Lens 22 may be held about an opening in inward extending portion 26.

Figure 3:
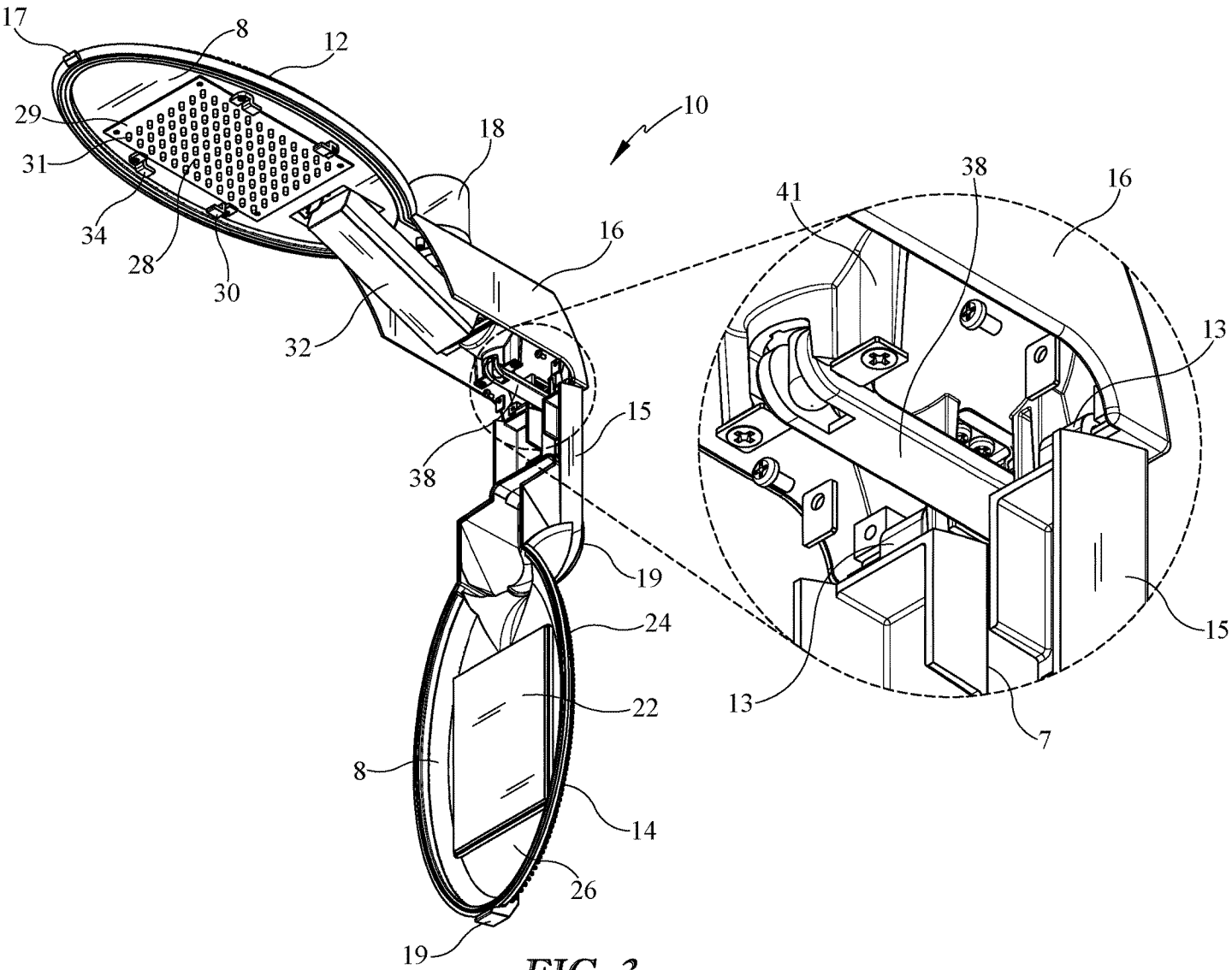
FIG. 3 is a perspective view of the LED street light shown in FIG. 1 showing a lower lid assembly hinged open from an upper lid assembly and showing internal components thereof.

FIG. 3 shows LED street light 10 hinged in an open configuration. Hinges 13 may hingedly hold lower lid arm 15 to upper lid arm 16. Lower lid assembly 14 may have a downward extending portion 24 proximate the perimeter of its light emitting portion 8. Lower lid assembly 14 may have inward extending portion 26 extending inwardly from downward extending portion 24. Lens 22 may be held about an opening in inward extending portion 26.

Locking mechanism 19 may be disposed on lower lid assembly 14 and may be configured and disposed to cooperate with locking extension 17, extending from upper lid assembly 12, and releasably hold lower lid assembly 14 with upper lid assembly 12.

Upper lid arm 16 may have controller 18 extending therefrom. For example, controller 18 may extend upwardly from upper lid arm 16. Upper lid assembly 12 may have light emitting portion 8 extending from upper lid arm 16. Light emitting portion 8 of upper lid assembly 12 may have an oval perimeter configured to mate with an oval perimeter about light emitting portion 8 of lower lid assembly 14. Upper lid assembly 12 may have locking extension 17 extending outward from its light emitting portion 8. Locking extension 17 may be configured and disposed to cooperate with locking mechanism 19 and hold lower lid assembly 14 to upper lid assembly 12.

Light emitting portion 8 of upper lid assembly 12 may be configured to removably hold printed circuit board, LED PCB, 29. For example, a pair of first LED PCB holders 30 may be configured to removably hold first edge portions of LED PCB 29 and a second pair of LED PCB holders 34 may be configured to removably hold second edge portions of LED PCB 29. LED PCB 29 may hold and electrically connect a plurality of LEDs 31. For example, LED PCB 29 may hold an array of LEDs 28 and provide for an electrical connection with driver 32. Driver 32 may be removably held with upper lid assembly 12 and may be configured to electrically connect to a power source and drive LEDs 31.

Shown in FIG. 3 is a bump out portion of LED street light 10. As shown therewith, hinges 13 may extend from lower lid arm 15 and hingedly cooperate with upper lid arm 16. Also shown therewith, cam lock arm holder 41 may extend from upper lid arm 16 and rotatably hold cam arm 38. Slot opening 7, in lower lid arm 15, may provide access to cam arm 38 when lower lid assembly 14 is rotated about hinges 13 and locked to upper lid assembly 12, with locking mechanism 19 and locking extension 17. Slot opening 7 may provide a means of attaching and releasing LED street light 10 to and from light post 20 when lower and upper lid assemblies 14 and 12 are locked together.

Figure 4:
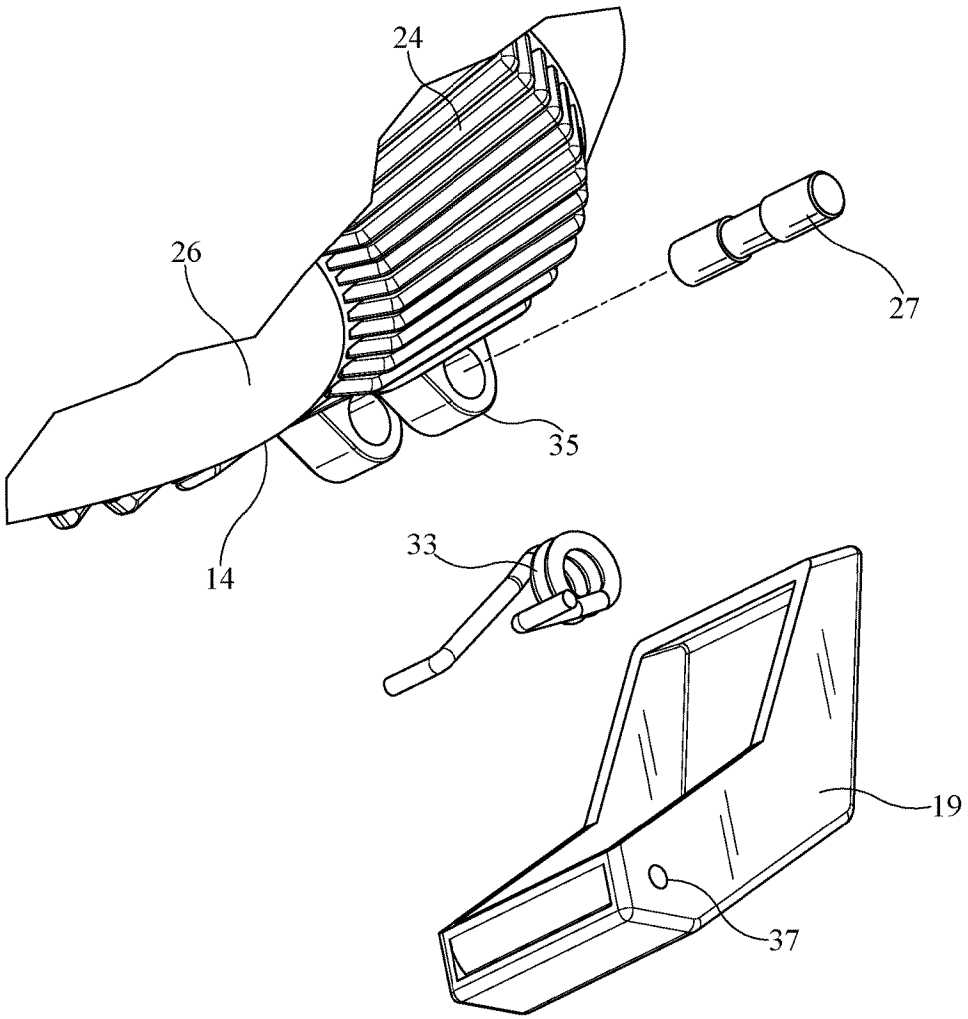
FIG. 4 shows a locking mechanism configured to hold the LED street light shown in FIG. 1 a closed configuration.

FIG. 4 shows an example of a locking mechanism 19. Downward extending portion 24 of lower lid assembly 14 extends downward toward inward extending portion 26. Spring rod receiver 35 may extend from downward extending portion 24. Spring 33 may be placed in rod receiver 35 and spring rod 27 may extend through spring 33 and spring rod receiver 35. Spring 33 may cooperate with portions of lower lid assembly 14 and locking mechanism 19, such as with apertures 37, and impart a spring bias to locking mechanism 19, biasing it in a locking position for locking with locking extension 17.

Figure 5:
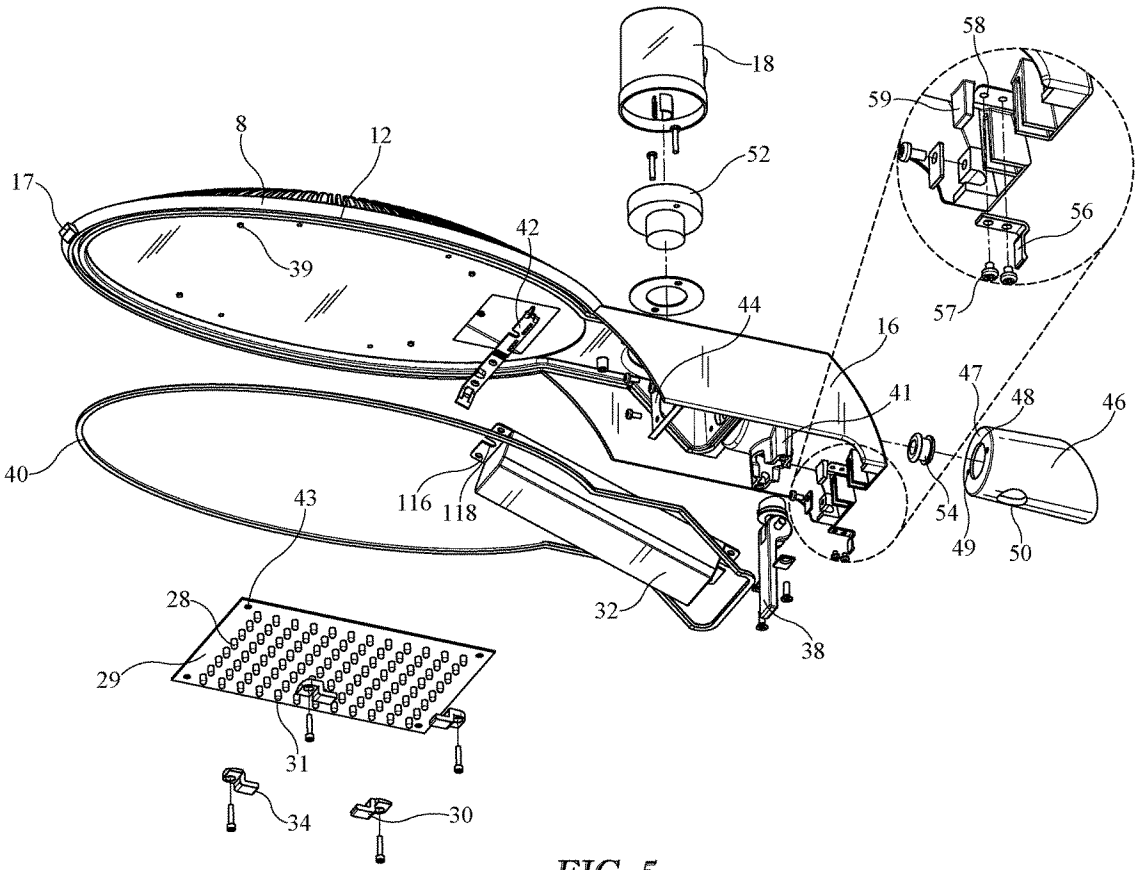
FIG. 5 is an exploded view of the upper lid assembly shown in FIG. 3.

FIG. 5 shows an exploded view of upper lid assembly 12 and optional adapter 46. Upper lid arm 16 may have controller 18 extending therefrom. For example, controller 18 may comprise one or more controllers such as a wife photo cell, dimming receptacle 52, or other controls configured to control the light output of LED street light 10. Cam lock arm holder 41 may extend from upper lid arm 16 and rotatably hold cam arm 38. Driver 32 may be removably held with upper lid assembly 12 and may be configured to electrically connect to a power source and drive LEDs 31. For example, driver holder 42 may be disposed with upper lid assembly 12 and configured to hold a first end of driver 32. Driver retainer clip 44 may be disposed with upper lid assembly 12 and configured to hold a second end of driver 32. Driver holder 42 and driver retainer clip 44 may be configured for tool-less placement and removal of driver 32, into and from upper lid assembly 12.

LED PCB locating pins 39 may extend from light emitting portion 8 of upper lid assembly 12. Locating pins 39 may be disposed to cooperate with apertures 43, in LED PCB 29, and configured to locate LED PCB 29 in light emitting portion 8 of upper lid assembly 12. For example, LED PCB 29 may be placed in position by hand and fastened to upper lid assembly 12 by hand rotating first and second LED PCB holders 30 and 34 into a holding orientation.

Upper lid arm 16 may comprise cam arm lock 56 configured and disposed to lock cam arm 38 in to a locked orientation. Cam arm lock 56 may be fastened, with fasteners 57, to upper lid assembly 12 at fastening sites 58. Cam arm lock 56 may have springing locking portion configured to slidingly receive cam arm 38 and lock it into a locked position. When in a locked position, can arm 38 may rest upon cam arm stop 59. Cam arm 38 may be unlocked by hand by applying pressure on the springing locking portion of cam arm lock 56 and unseating cam arm 38 from cam arm lock 56.

Optionally, the LED street light of the present disclosure may comprise light post adapter 46. Light post adapter 46 may be configured to enable the LED street light of the present disclosure to be removably fastened to light posts of different sizes. Light post adapter 46 may have a conical sidewall and may have a side opening 50 therein. Side opening 50 may be configured to receive cam pad 68, shown in FIG. 6. Inward extension 47 may extend inwardly from an end of the sidewall and may have an end opening 48. Inward extension 47 may have one or more apertures 49 positioned about end opening 48. End opening 48 and apertures 49 may be configured and disposed for wiring the LED street light of the present disclosure to a power source. Grommet 54 may be configured to be disposed with light post adapter 46 or the LED street light of the present disclosure and may guide or protect wires.

Figure 6:
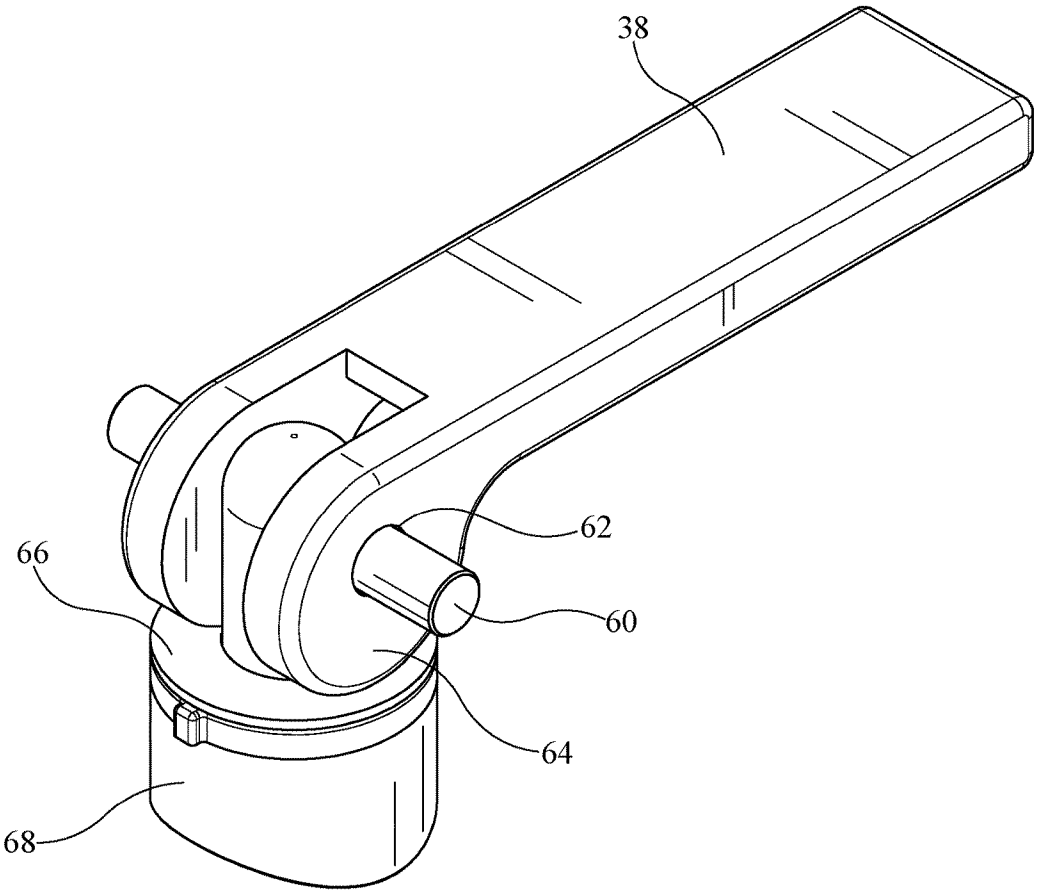
FIG. 6 shows an example of a lock configured and disposed to fasten and unfasten the LED street light of the present disclosure to and from a street light post.

FIG. 6 shows an example of cam arm 38 and the lock in the support arm configured and disposed to fasten and unfasten the support arm to and from a street light post. The lock may be a cam lock configured and disposed to lock and hold the housing to the light post. The cam lock may have a cam lock lever holder 41, shown in FIG. 5, extending from upper lid arm 16. Cam arm 38 may have a camming portion 64 with an aperture 62 extending through two parallel camming plates. A cam post 66 may have a slotted extension extending from a cam pad 68. Cam pin 60 may extend trough the slotted extension and apertures 62 in the two parallel camming plates in camming portion 64. Cam lock lever holder 41 may be configured to rotatingly hold end portions of cam pin 60 extending out from the two parallel camming plates. Cam pad 68 may have a concave end configured to extend, upon rotation of cam arm 38, and grip a light post.

Figure 7:
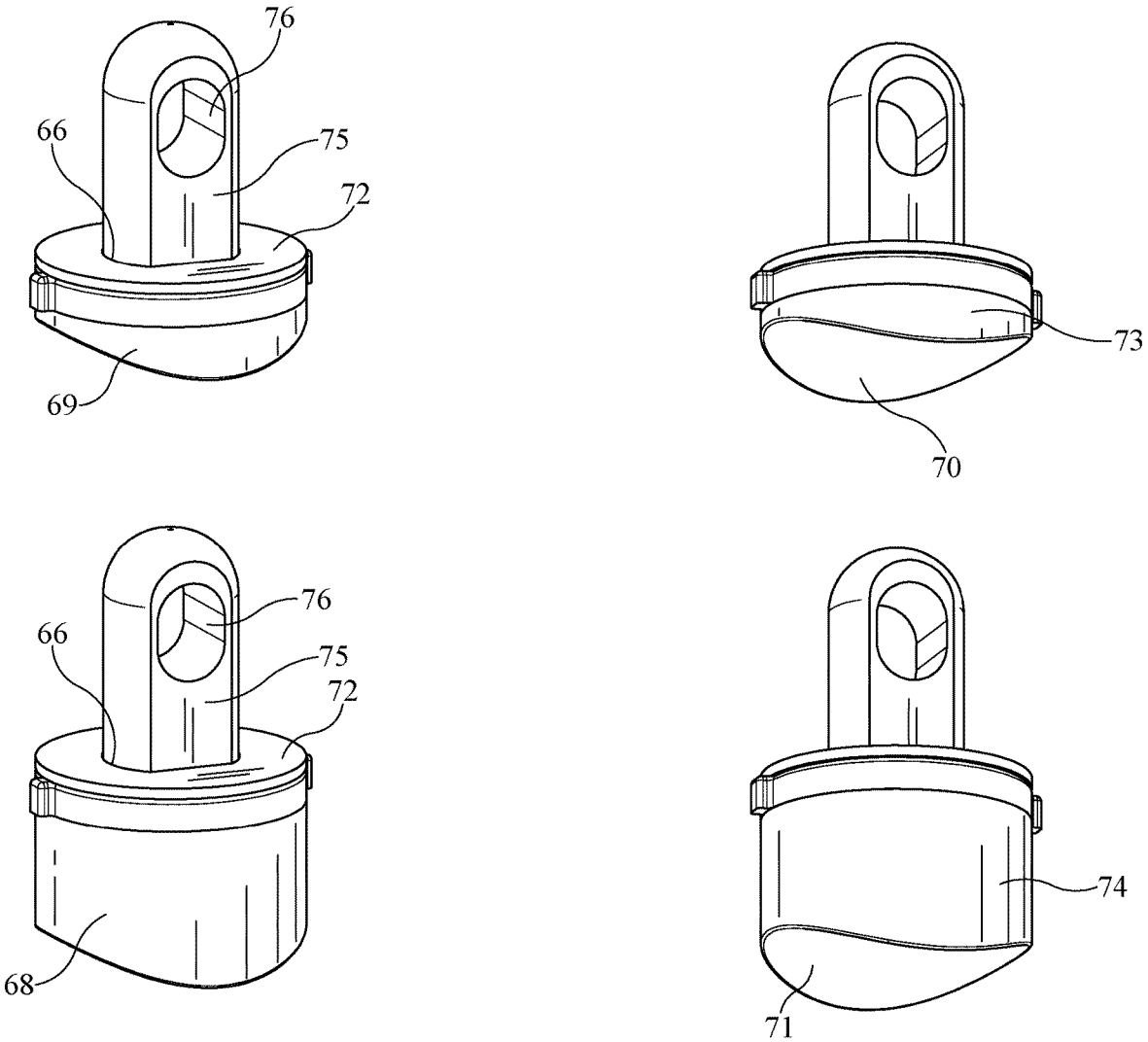
FIGS. 7 and 8 show examples of cam posts and cam pads that may be incorporated with the lock shown in FIG. 6.
Figure 8:
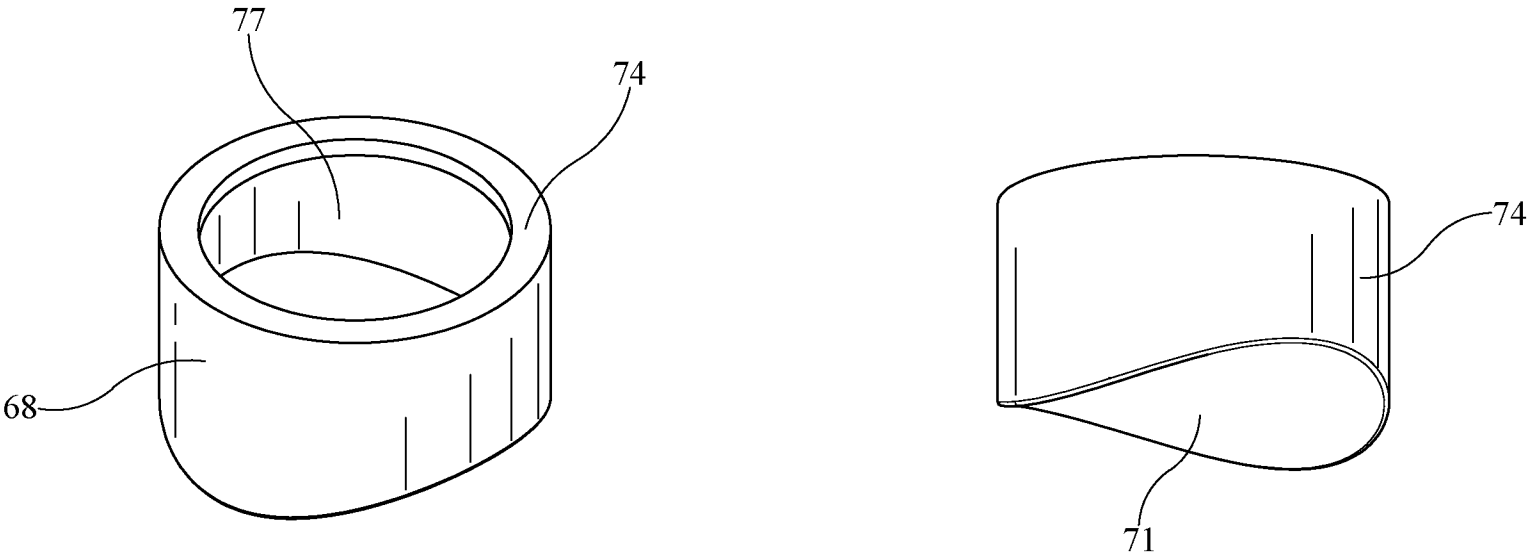

FIGS. 7 and 8 show examples of cam posts and cam pads that may be incorporated with the LED street light of the present disclosure. Cam post 66 may have cam post extension 75 with cam post extension opening 76, which may be a slot. Disc 72 may extend from cam post extension 75 and may have guide tabs extending from a perimeter thereof. A cam pad, 68 or 69, for example, may extend from Disc 72. The cam pad may be configured to grip different sized light posts. For example, cam pad 68 may be configured to grip a 1.5 inch diameter light post and cam pad 69 may be configured to grip a 2 inch diameter light post. Cam pad 68 may have concave cam pad surface 71 and cam pad sidewall 74 configured to grip a 1.5 inch diameter light post, upon rotation of cam arm 38. Cam pad 69 may have concave cam pad surface 70 and cam pad sidewall 73 configured to grip a 2 inch diameter light post, upon rotation of cam arm 38. Cam pad 68 or 69 may have an opening 77 configured to grip about a portion of cam post extension 75, extending beyond disc 72.

Figure 9:
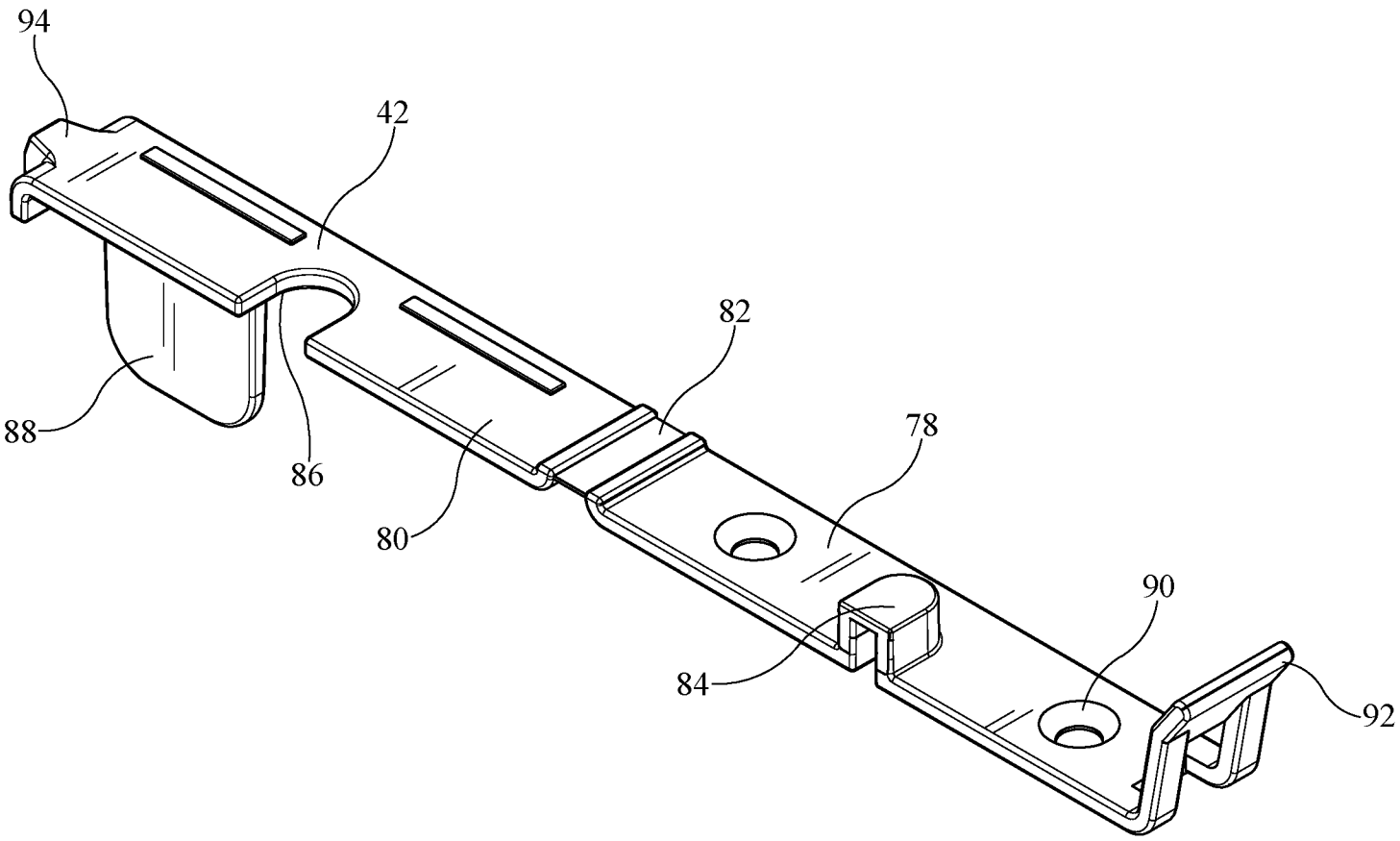
FIG. 9 shows the driver holder shown in FIG. 5.

FIG. 9 shows an example of driver holder 42. Driver holder 42 may have a first leg 78 and a second leg 80 with hinging portion 82 therebetween. An alignment extension 84 may extend from first leg 78. Second leg 80 may have alignment notch 86 configured to receive alignment extension 84. Driver 32 may have flange 116 extending from a sidewall. Flange 116 may have notch 118, as shown in FIG. 5, configured to be disposed to receive alignment extension 84.

For example, alignment extension 84 may have a "U" shape configured to pass through a "U" cut notch 118 in a driver 32 bottom panel or flange 116 and be received with alignment notch 86, which also may have a "U" shape. Tab 88 may extend from second leg 80 and may be configured and disposed to provide gripping, by hand, for tool-less installation and removal of driver 32. First leg 78 may have one or more fastener apertures 90 configured and disposed to receive a fastener and fasten driver holder 42 to upper lid assembly 12. First leg 78 may have clip 92 extending from an end thereof configured to cooperate with driver holder second leg extension 94 and provide for tool-less clipping of first leg 78 with second leg 80.

Figure 10:
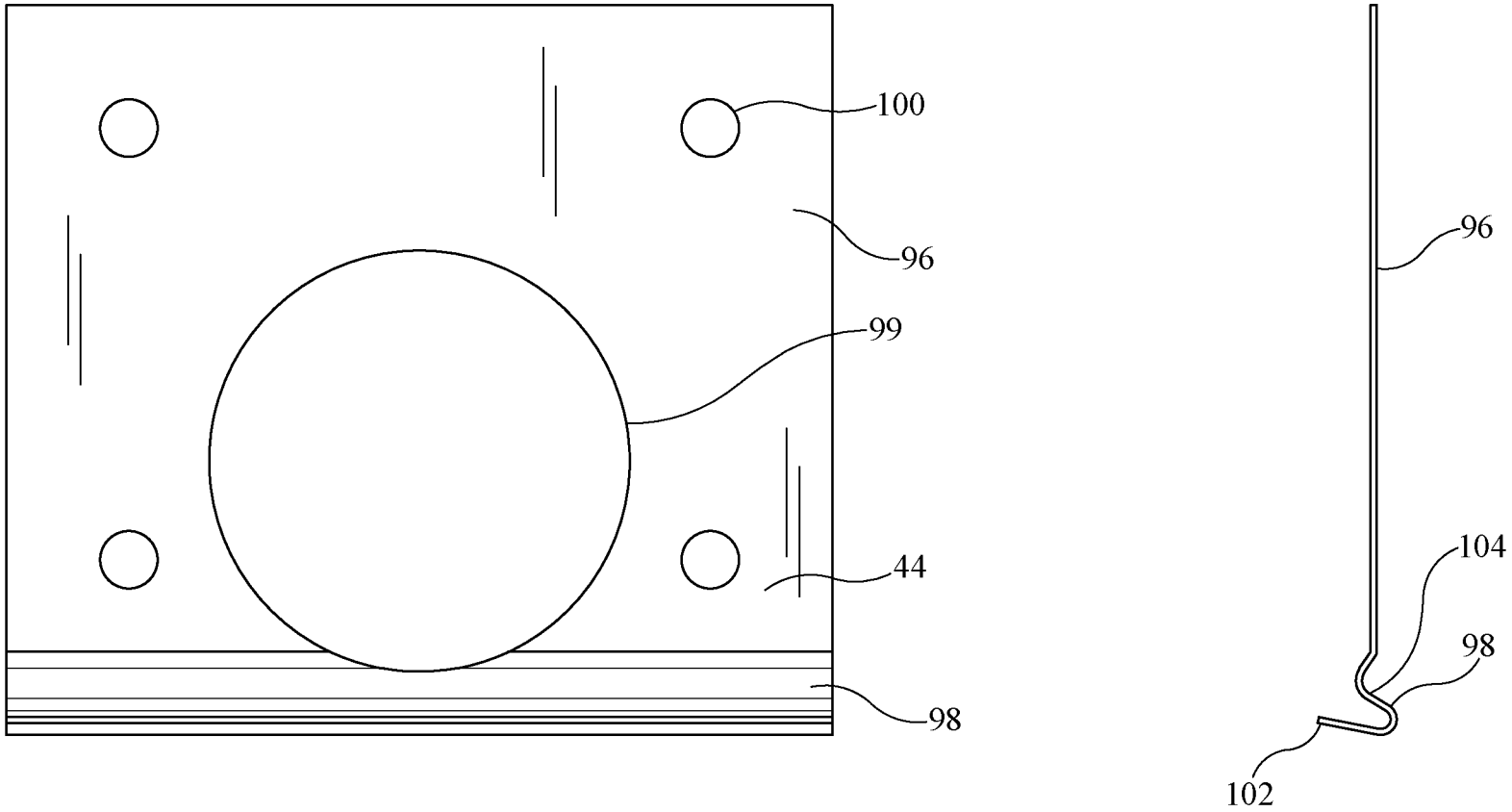
FIG. 10 shows the driver retainer clip shown in FIG. 5.

FIG. 10 shows driver retainer clip 44. Driver retainer clip 44 may have planar portion 96 with fastener openings 100 configured to be fastened to upper lid assembly 12. Driver retainer clip 44 may have an opening 99 for extending wires from a power source to driver 32. Driver retainer clip 44 may have non-planar portion 104 extending from planar portion 96. Clipping portion 98 may extend from non-planar portion 104 and may terminate with clip extending portion 102. Non-planar portion 104, clipping portion 98, and extending portion 102 may provide an "S" shaped extension, extending from planar portion 96, which may be configured to be disposed to hold a surface of driver 32.

Driver holder 42 and driver retainer clip 44 may provide for tool-less installation and removal of driver 32, into and out of upper lid assembly 12. For example, driver 32 may have an upper surface placed within extending portion 102 and have notch 118, extending from a lower surface, placed to receive alignment extension 84. First leg 78 and second leg 80 may then be clipped together, with clip 92 and second leg extension 94, and hold driver 32 in upper lid assembly 12.

Figure 11:
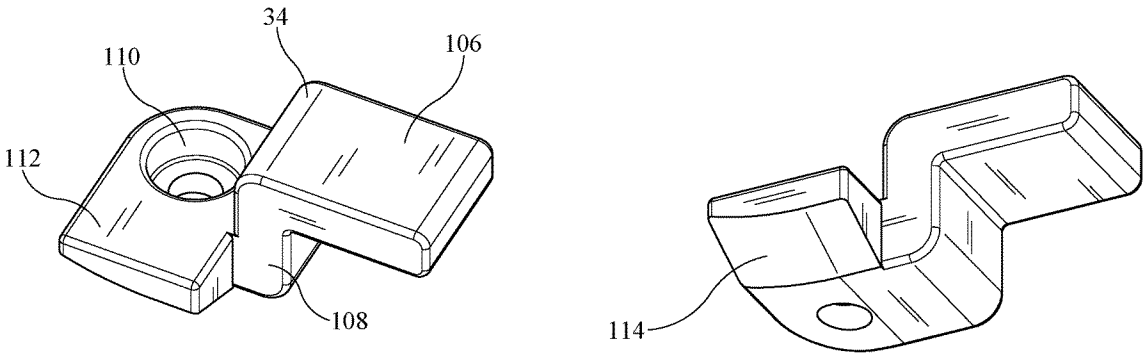
FIG. 11 shows the LED PCB holder shown in FIG. 5.

FIG. 11 shows second LED PCB holder 34. LED PCB holder 34 may have a first extension 106 with a second extension 108 extending therefrom forming an "L" shape. Third extension 112 may extend from second extension 108 which may be substantially in a plane parallel with a plane of first extension 106. Third extension 112 may have a portion extending beyond the width of first and second extensions 106 and 108. Third extension 112 may have an aperture 110 configured to rotatingly hold PBC holder 34 to upper lid assembly 12. Third extension 112 may have sloping surface 114 configured to slide about LED PCB 29 and hold it in place, with rotation of PCB holder 34. First LED PCB holder 30 may have a similar configuration with third extension 112 extending beyond the opposite edge of second extension as compared to second LED PCB holder 34. Such a configuration may enable PCB holder 30 to be rotated in an opposite direction as PCB holder and hold LED PCB 29 in place.

Also provided herein is a method for tool-lessly installing the LED street light 10. LED street light 10 may be installed by sliding the support arm onto the street light post and rotating a cam lock, by hand, and gripping and holding the support arm to the street light post. The driver may be placed on the driver holder and portions of the driver holder may be clipped together to hold the driver in the housing. The LED PCB may be placed in the light emitting portion of the housing and at least two LED PCB holders may be rotated to hold the LED PCB in the light emitting portion. The lower lid assembly may be rotated about a hinge to mate with an upper lid assembly and the lower lid assembly may be locked to the upper lid assembly. A light post adapter may be placed about the light post prior to the step of sliding the support arm onto the street light post to provide installation on a light post of a different size.

The invention is illustrated by way of example in the drawing Figures and throughout the written description. It should be understood that numerous variations of the presently disclosed LED street light are possible, for example, variations of the housing, the lock in the support arm, the LED PCB holders, and the driver holder and/or retainer clip, and such variations are a part of the presently claimed LED street light.

One feature or aspect of an embodiment is believed at the time of the filing of this patent application to possibly reside broadly in an LED Street Light 10 comprising a housing 11 having a support arm 6 extending from a light emitting portion 8. A lock 38 may be disposed in the support arm 6 configured and disposed to tool-lessly fasten and unfasten the support arm 6 to and from a street light post 20. An LED PCB 29 having an array of LEDs 28 may be tool-lessly removably held in the light emitting portion 8 of the LED street light 10. A tool-lessly removable driver 32 may be housed in LED street light 10 configured and disposed to electrically connect to a power source and power the array of LEDs 28.

Another feature or aspect of an embodiment is believed at the time of the filing of this patent application to possibly reside broadly in an LED street light wherein the lock in the support arm comprises a cam lock 38 configured to grip and hold the support arm 6 to the street light post 20.

Yet another feature or aspect of an embodiment is believed at the time of the filing of this patent application to possibly reside broadly in an LED street light wherein the cam lock 38 comprises a concave cam pad 68 configured to grip and hold a round street light post 20.

Still another feature or aspect of an embodiment is believed at the time of the filing of this patent application to possibly reside broadly in an LED street light comprising a driver retainer clip 44 and a driver holder 42, wherein the driver retainer clip 44 and the driver holder 42 are configured and disposed to tool-lessly and removably hold the driver 32 in the housing 11.

A further feature or aspect of an embodiment is believed at the time of the filing of this patent application to possibly reside broadly in an LED street light wherein the driver retainer clip 44 is configured and disposed to hold a first end of the driver 32 and the driver holder 42 is configured and disposed a second end of the driver 32.

Another feature or aspect of an embodiment is believed at the time of the filing of this patent application to possibly reside broadly in an LED street light wherein the driver holder 42 comprises, a first leg 78 fastened to the housing 11, a second leg 80 hingedly extending from the first leg 78, and a clip 92 at the end opposite of the hinge on the first or second leg configured and disposed to removably clip with the end opposite of the hinge on the other of the first or second leg.

Yet another feature or aspect of an embodiment is believed at the time of the filing of this patent application to possibly reside broadly in an LED street light wherein the first leg 78 or second leg 80 of the driver holder 42 comprises an alignment extension 84 and the other of the first leg or second leg comprises an alignment notch 86, wherein the alignment notch is configured and disposed to receive the alignment extension.

Still another feature or aspect of an embodiment is believed at the time of the filing of this patent application to possibly reside broadly in an LED street light wherein the driver has a flange 116 with a notch 118 configured to receive the alignment extension 84.

A further feature or aspect of an embodiment is believed at the time of the filing of this patent application to possibly reside broadly in an LED street light wherein the alignment extension 84 has a half-moon configuration.

Another feature or aspect of an embodiment is believed at the time of the filing of this patent application to possibly reside broadly in an LED street light comprising a plurality of LED PCB holders, 30 and/or 34, rotatably attached to the light emitting portion 8 of the housing 11, the plurality of LED PCB holders may be configured and disposed to provide tool-less installation and removal of the LED PCB 29, into and out of the housing 11, with rotation of the LED PCB holders, 30 and/or 34.

Yet another feature or aspect of an embodiment is believed at the time of the filing of this patent application to possibly reside broadly in an LED street light comprising four LED PCB holders, 30 and/or 34, wherein each LED PCB holder is disposed in the housing 11 and is configured to hold an edge portion of the LED PCB 29, upon rotation of the LED PCB holder.

One feature or aspect of an embodiment is believed at the time of the filing of this patent application to possibly reside broadly in an LED street light wherein each LED PCB holder, 30 and/or 34, comprises a first extension 106, a second extension 108 perpendicularly extending from the first extension 106, and a third extension 112 extending from the second extension 108, in a plane parallel with the first extension 106. The third extension 112 may have an aperture 110 configured and disposed to rotatingly receive a fastener and a sloping surface 114 configured and disposed to slide over the LED PCB 29 and hold the LED PCB 29 in the light emitting portion 8 of the housing 11, upon rotation of the LED PCB holder, 30 and/or 34.

Another feature or aspect of an embodiment is believed at the time of the filing of this patent application to possibly reside broadly in an LED street light wherein the plurality of LED PCB holders comprise at least one LED PCB holder of a first configuration 30 and at least one LED PCB holder of a second configuration 34, wherein the sloping surface 114 of the LED PCB holder of the first configuration 30 is configured and disposed to slide over the LED PCB 29 and hold the LED PCB 29 in the light emitting portion 8 of the housing 11, upon a clockwise or counter-clockwise rotation of the LED PCB holder 30, and the sloping surface 114 of the LED PCB holder 34 of the second configuration is configured and disposed to slide over the LED PCB 29 and hold the LED PCB 29 in the light emitting portion 8 of the housing 11, upon the other of a clockwise or counter-clockwise rotation of the LED PCB holder 34.

Yet another feature or aspect of an embodiment is believed at the time of the filing of this patent application to possibly reside broadly in an LED street light comprising LED PCB locating pins 39 extending from the light emitting portion 8, each LED PCB locating pin 39 may be configured and disposed to be received with an aperture 43 in the LED PCB 29.

Still another feature or aspect of an embodiment is believed at the time of the filing of this patent application to possibly reside broadly in an LED street light comprising an adapter 46, the support arm 6 being configured for fastening to a street light post having a first size and the adapter 46 being configured for fastening the LED street light 10 to a street light post having a second size.

A further feature or aspect of an embodiment is believed at the time of the filing of this patent application to possibly reside broadly in an LED street light wherein the adapter comprises a side opening 50 configured to receive a portion of the lock 68, in the support arm.

Another feature or aspect of an embodiment is believed at the time of the filing of this patent application to possibly reside broadly in an LED street light comprising an upper lid assembly 12 and a lower lid assembly 14 attached to each other with a hinge 13 in the support arm 6.

Yet another feature or aspect of an embodiment is believed at the time of the filing of this patent application to possibly reside broadly in an LED street light comprising a locking mechanism 19 in the light emitting portion 8 configured and disposed to lock and unlock the lower lid assembly 14 to and from the upper lid assembly 12.

| Nomenclature | |
|---|---|
| support arm | 6 |
| slot opening | 7 |
| light emitting portion | 8 |
| street light | 10 |
| housing | 11 |
| upper lid assembly | 12 |
| hinge | 13 |
| lower lid assembly | 14 |
| lower lid arm | 15 |
| upper lid arm | 16 |
| locking extension | 17 |
| controller | 18 |
| locking mechanism | 19 |
| light post | 20 |
| lens | 22 |
| opening in upper lid support arm | 23 |
| downward extending portion of lower lid assembly | 24 |
| inward extending portion of lower lid | 26 |
| spring rod | 27 |
| array of LEDs | 28 |
| LED PCB | 29 |
| first LED PCB holder | 30 |
| LED | 31 |
| driver | 32 |
| spring | 33 |
| second LED PCB holder | 34 |
| spring rod receiver | 35 |
| aperture | 37 |
| cam arm | 38 |
| LED PCB locating pin | 39 |
| gasket | 40 |
| cam lock arm holder | 41 |
| driver holder | 42 |

-continued

| Nomenclature | |
|---|---|
| aperture | 43 |
| driver retainer clip | 44 |
| light post adapter | 46 |
| inward extension | 47 |
| end opening | 48 |
| aperture | 49 |
| side opening | 50 |
| dimming receptacle | 52 |
| grommet | 54 |
| cam arm lock | 56 |
| fastener | 57 |
| fastening site | 58 |
| cam arm stop | 59 |
| cam pin | 60 |
| cam pin aperture | 62 |
| camming portion of cam arm | 64 |
| cam post | 66 |
| cam pad | 68 |
| cam pad | 69 |
| cam pad surface | 70 |
| cam pad surface | 71 |
| disc | 72 |
| cam pad sidewall | 73 |
| cam pad sidewall | 74 |
| cam post extension | 75 |
| cam post extension opening | 76 |
| cam pad opening | 77 |
| driver holder first leg | 78 |
| driver holder second leg | 80 |
| driver holder hinging portion | 82 |
| alignment extension | 84 |
| alignment notch | 86 |
| tab | 88 |
| fastener aperture | 90 |
| clip | 92 |
| driver holder second leg extension | 94 |
| driver retainer clip planar portion | 96 |
| driver retainer clip clipping portion | 98 |
| driver retainer clip wire opening | 99 |
| driver retainer clip fastener opening | 100 |
| driver retainer clip extending portion | 102 |
| driver retainer clip non-planar portion | 104 |
| LED PCB holder first extension | 106 |
| LED PCB holder second extension | 108 |
| aperture | 110 |
| LED PCB holder third extension | 112 |
| sloping surface | 114 |
| driver flange | 116 |
| notch in driver flange | 118 |

The invention claimed is:

1. An LED street light configured for tool-less installation comprising:

a housing having a support arm extending from a light emitting portion;

a lock in the support arm configured and disposed to tool-lessly fasten and unfasten the support arm to and from a street light post;

an LED PCB having an array of LEDs, wherein the LED PCB is tool-lessly removably held in the light emitting portion of the LED street light;

a tool-lessly removable driver housed in the LED street light configured and disposed to electrically connect to a power source and power the array of LEDs;

a driver retainer clip configured and disposed to hold a first end of the driver; and a driver holder configured and disposed to hold a second end of the driver, wherein the driver holder comprises:

a first leg fastened to the housing;

a second leg hingedly extending from the first leg; and a clip at the end opposite of the hinge on the first or second leg configured and disposed to removably clip with the end opposite of the hinge on the other of the first or second leg.

2. The LED street light of claim 1, wherein the lock in the support arm comprises a cam lock configured to grip and hold the support arm to the street light post.

3. The LED street light of claim 2, wherein the cam lock comprises a concave cam pad configured to grip and hold a round street light post.

4. The LED street light of claim 1, wherein the first or second leg comprises an alignment extension and the other of the first or second leg comprises an alignment notch, wherein the alignment notch is configured and disposed to receive the alignment extension.

5. The LED street light of claim 4, wherein the driver has a flange with a notch configured to receive the alignment extension.

6. The LED street light of claim 5, wherein the alignment extension has a half-moon configuration.

7. The LED street light of claim 1 further comprising a plurality of LED PCB holders rotatably attached to the light emitting portion of the housing, the plurality of LED PCB holders being configured and disposed to provide tool-less installation and removal of the LED PCB, into and out of the housing, with rotation of the LED PCB holders.

8. The LED street light of claim 7 comprising four LED PCB holders, wherein each LED PCB holder is rotatingly disposed in the housing and configured to hold an edge portion of the LED PCB, upon rotation of the LED PCB holder.

9. An LED street light configured for tool-less installation comprising:

a housing having a support arm extending from a light emitting portion;

a lock in the support arm configured and disposed to tool-lessly fasten and unfasten the support arm to and from a street light post;

an LED PCB having an array of LEDs, wherein the LED PCB is tool-lessly removably held in the light emitting portion of the LED street light;

a tool-lessly removable driver housed in the LED street light configured and disposed to electrically connect to a power source and power the array of LEDs; and a plurality of LED PCB holders rotatably attached to the light emitting portion of the housing, the plurality of LED PCB holders being configured and disposed to provide tool-less installation and removal of the LED PCB, into and out of the housing, with rotation of the LED PCB holders;

wherein each LED PCB holder is rotatingly disposed in the housing and configured to hold an edge portion of the LED PCB, upon rotation of the LED PCB holder;

wherein each LED PCB holder comprises:

a first extension;

a second extension perpendicularly extending from the first extension;

a third extension extending from the second extension in a plane parallel with the first extension;

the third extension having an aperture configured and disposed to rotatingly receive a fastener; and the third extension having a sloping surface configured and disposed to slide over the LED PCB and hold the LED PCB in the light emitting portion of the housing, upon rotation of the LED PCB holder.

10. The LED street light of claim 9, wherein the plurality of LED PCB holders comprise at least one LED PCB holder of a first configuration and at least one LED PCB holder of a second configuration, wherein the sloping surface of the LED PCB holder of the first configuration is configured and disposed to slide over the LED PCB in the light emitting portion of the housing, upon its clockwise or counter-clockwise rotation, and the sloping surface of the LED PCB holder of the second configuration is configured and disposed to slide over the LED PCB in the light emitting portion of the housing, upon the other of a clockwise or counter-clockwise rotation.

11. The LED street light of claim 9 further comprising LED PCB locating pins extending from the light emitting portion, each LED PCB locating pin being configured and disposed to be received with an aperture in the LED PCB.

12. The LED street light of claim 9 further comprising an adapter, the support arm being configured for fastening to a street light post having a first size and the adapter being configured for fastening the LED street light to a street light post having a second size.

13. The LED street light of claim 12, wherein the adapter comprises a side opening configured to receive a portion of the lock in the support arm.

14. The LED street light of claim 9 comprising an upper lid assembly and a lower lid assembly attached to each other with a hinge in the support arm.

15. The LED street light of claim 14 comprising a locking mechanism in the light emitting portion configured and disposed to lock and unlock the lower lid assembly to and from the upper lid assembly.

16. A method for tool-lessly installing an LED street light, the LED street light comprising:

a housing having a support arm extending from a light emitting portion;

a lock in the support arm configured and disposed to tool-lessly fasten and unfasten the support arm to and from a street light post;

an LED PCB having an array of LEDs, wherein the LED PCB is tool-lessly removably held in the light emitting portion of the LED street light; and a tool-lessly removable driver housed in the LED street light configured and disposed to electrically connect to a power source and power the array of LEDs;

the method comprising the steps of:

sliding the support arm onto the street light post;

rotating a cam lock, by hand, and gripping and holding the support arm to the street light post;

placing the driver on a driver holder;

clipping portions of the driver holder together and holding the driver in the housing;

placing the LED PCB in the light emitting portion of the housing;

rotating at least two LED PCB holders and holding the LED PCB in the light emitting portion;

rotating a lower lid assembly, about a hinge, to mate with an upper lid assembly; and locking the lower lid assembly to the upper lid assembly.

17. The method for tool-lessly installing the LED street light of claim 16 further comprising a step of installing a light post adapter about the light post prior to the step of sliding the support arm onto the street light post.

* * * * *